US009159311B2

(12) United States Patent
Goodson

(10) Patent No.: US 9,159,311 B2
(45) Date of Patent: Oct. 13, 2015

(54) UNRESTRICTED MOUNTING OF ULTRASONIC TRANSDUCERS

(76) Inventor: J. Michael Goodson, Skillman, NJ (US)

( * ) Notice: Subject to any disclaimer, the term of this patent is extended or adjusted under 35 U.S.C. 154(b) by 500 days.

(21) Appl. No.: 13/078,766

(22) Filed: Apr. 1, 2011

(65) Prior Publication Data

US 2011/0242944 A1 Oct. 6, 2011

Related U.S. Application Data

(60) Provisional application No. 61/320,015, filed on Apr. 1, 2010.

(51) Int. Cl.
*G10K 11/00* (2006.01)

(52) U.S. Cl.
CPC ..... *G10K 11/006* (2013.01)

(58) Field of Classification Search
CPC ..... B60B 3/00; B60B 1/0618; B08B 3/12; G10K 11/006
USPC ..... 73/866.5, 290 V, 290 R, 304 R, 617, 644; 367/173; 134/1, 105
See application file for complete search history.

(56) References Cited

U.S. PATENT DOCUMENTS

| | | | | | |
|---|---|---|---|---|---|
| 3,700,937 | A * | 10/1972 | Rissolo | 310/337 |
| 3,825,025 | A * | 7/1974 | Samuel et al. | 137/392 |
| 3,985,344 | A * | 10/1976 | McCord | 366/127 |
| 4,107,790 | A * | 8/1978 | McCord | 366/127 |
| 4,158,964 | A * | 6/1979 | McCrea et al. | 73/290 V |
| 5,037,481 | A * | 8/1991 | Bran | 134/1 |
| 5,087,379 | A * | 2/1992 | Morton et al. | 210/748.05 |
| 5,200,666 | A * | 4/1993 | Walter et al. | 310/323.01 |
| 2007/0283985 | A1 * | 12/2007 | Goodson | 134/58 R |
| 2009/0095070 | A1 * | 4/2009 | Battefeld et al. | 73/290 V |

* cited by examiner

*Primary Examiner* — Daniel S Larkin
*Assistant Examiner* — Jamar Ray
(74) *Attorney, Agent, or Firm* — K&L Gates LLP

(57) ABSTRACT

An ultrasonic processing apparatus is disclosed that supports an ultrasonic rod transducer without restricting the transmission of ultrasonic vibrations from the rod transducer to liquid in a processing tank. A support structure supports one or both converter heads of the rod transducer without restricting its vibration.

14 Claims, 4 Drawing Sheets

UNRESTRICTED MOUNTING OF ULTRASONIC TRANSDUCERS

RELATED APPLICATION

This application claims priority from co-pending U.S. Provisional Application No. 61/320,015, filed Apr. 1, 2010, entitled Ultrasonic Transducer Sound Transmission Enhancements, and invented by J. Michael Goodson. This prior application is expressly incorporated herein by reference.

BACKGROUND OF THE INVENTION

1. Field of the Invention

This invention relates generally to ultrasonic apparatus and associated process methods for improving transmission of ultrasonic vibrations into liquids, and relates more specifically to mounting of ultrasonic transducers in a way that reduces or eliminates restrictions to the free flow of ultrasonic energy.

2. Description of the Relevant Art

One type of ultrasonic transducer is a rod transducer with an ultrasonic converter head located at one or both ends of a rod. Each ultrasonic converter head includes one or more piezoelectric devices that expand and contract with applied electrical voltage. The rod acts as a resonator that longitudinally transmits ultrasonic vibrations generated by the converter head(s). The rod transducer is intended for immersion into a liquid-filled tank so that the ultrasonic vibrations are transmitted to the liquid for processing in the tank. Rod transducers are disclosed, for example, in U.S. Pat. No. 5,200,666.

Rod transducers are commonly mounted to an inside wall of a tank. As shown in FIGS. 1A, 1B, and 1C, a rod transducer 10 is attached to a tank wall 12 using two brackets 14 and 16. One bracket 14 is securely tightened to firmly support one converter head 18 of the rod transducer 10. The other bracket 16 is loosely fitted to the other converter head 20 to hold the other end of the rod transducer 10 in place without unduly restricting the ultrasonic movement of the converter. A cable 22 connects the rod transducer 10 to a power source.

FIG. 2 shows a known configuration for mounting a single-ended rod transducer 30. This transducer has one converter head 32 located above a tank or vessel 34 and a rod 36 that extends downwardly into the tank. A transducer rod support arm 38 is clamped to the rod 36 to support the rod transducer 30 over the tank or vessel 34.

It is desirable to transmit as much of the ultrasonic vibrations from the rod transducer to the liquid in the tank as possible. What is needed is an improved supporting structure that improves the transmission of ultrasonic vibrations into the liquid instead of the supporting structure.

SUMMARY OF THE INVENTION

The present invention is an ultrasonic processing apparatus that supports an ultrasonic rod transducer without restricting the transmission of ultrasonic vibrations from the rod transducer to liquid in a processing tank. A support structure supports one or both converter heads of the rod transducer without restricting its vibration.

Reducing restrictions that impede the transmission of sound in ultrasonic transducers can significantly improve the performance of transducers. By changing the mounting to an unrestricted form, the sound is transmitted freely and the performance is enhanced. In one test, performance was improved by 25% at a frequency of 25 KHz with a 2000 watt generator and a watt density of 15 watts per gallon. The transducer rod was an alloy of titanium and aluminum.

Immersible rod transducers will perform better without being affixed to the tank for which they provide ultrasonic power. The transmission of sound can be further enhanced by using a flexible mounted surface between the tank and the rod transducer.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENTS

The drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 3:
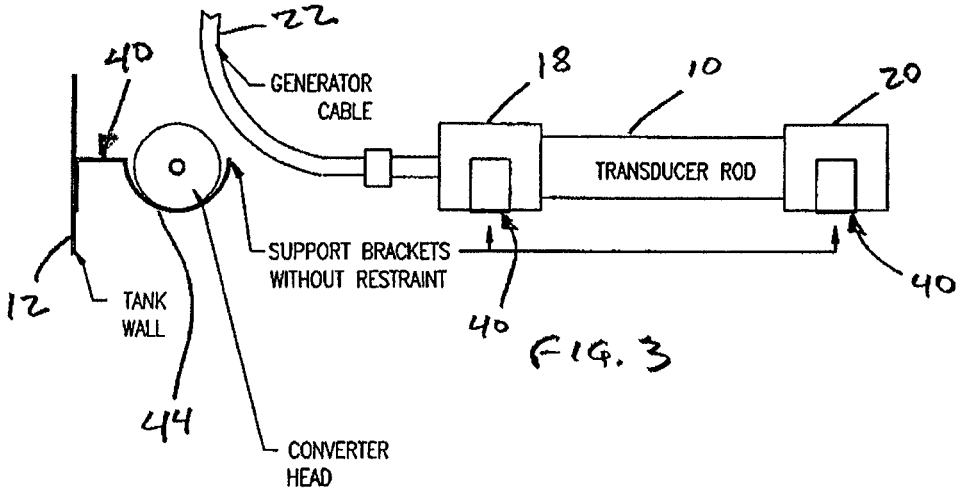
FIG. 3 is an end view and a front view of one embodiment of an unrestricted mounting for an ultrasonic transducer according to the present invention.

One embodiment of an improved support structure according to the present invention is shown in FIG. 3, which includes two support brackets 40 attached to the wall 12 of the tank. Each support bracket 40 extends outwardly from the tank wall 12 and has a semi-circular cradle 44 that supports the converter heads 18 and 20 of the rod transducer 10. The rod transducer 10 rests in the cradles 44 of the support brackets 40, but is free to vibrate without restriction from the brackets. The support brackets are preferably stainless steel or other suitable metal. The cradles 44 may be lined with a soft material where it supports the converter heads. These support brackets 40 allow more of the ultrasonic vibrations from the rod transducer to be transmitted to the liquid instead of the supporting structure.

Figure 4:
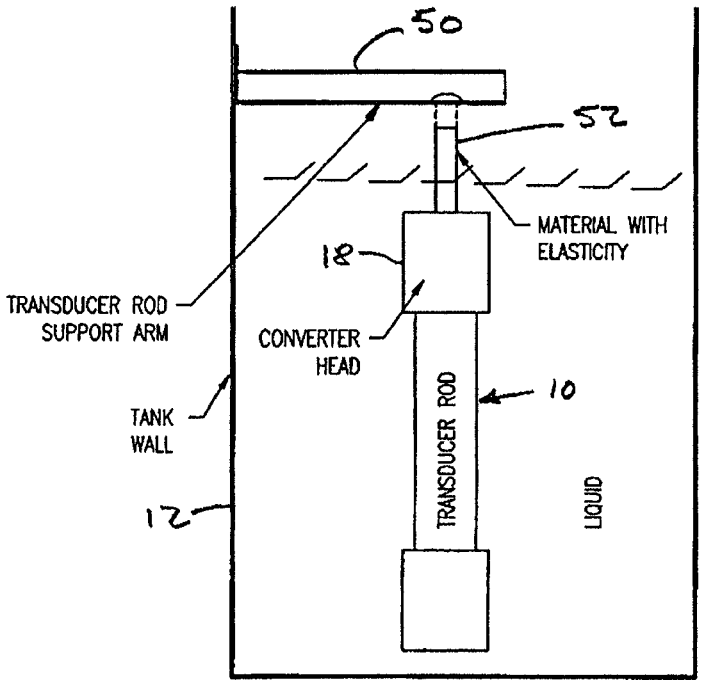
FIG. 4 is a side view of another embodiment of an unrestricted mounting for an ultrasonic transducer according to the present invention.

Another embodiment of the present invention, shown in FIG. 4, suspends the rod transducer 10 from a support arm 50 using an elastic support 52. One end of the elastic material 52 is attached to one converter head 18 and the other end of the elastic support is attached to the support arm 50. The elastic support is composed of flexible or elastic materials such as polymer or rubber in the shape of wire or chain. The support arm 50 is attached to the tank wall 12 or other structure and is preferably located above the top surface of the liquid in the tank so as not to absorb any of the ultrasonic vibrations in the tank. The rod transducer 10 is supported above the bottom of the tank so that nothing restricts the transmission of ultrasonic energy from the rod transducer to the surrounding liquid.

Figure 1A:
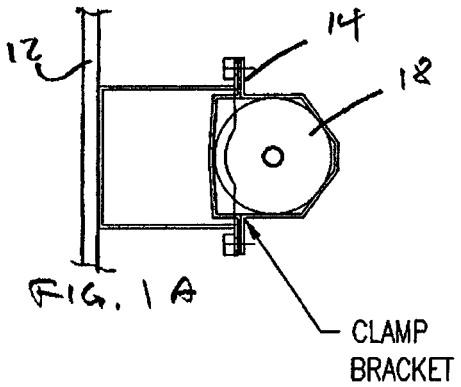
FIG. 1A PRIOR ART
FIGS. 1A, 1B, and 1C are a top view, side view, front view of a prior art mounting of an ultrasonic rod transducer using a clamping bracket.
Figure 1B:
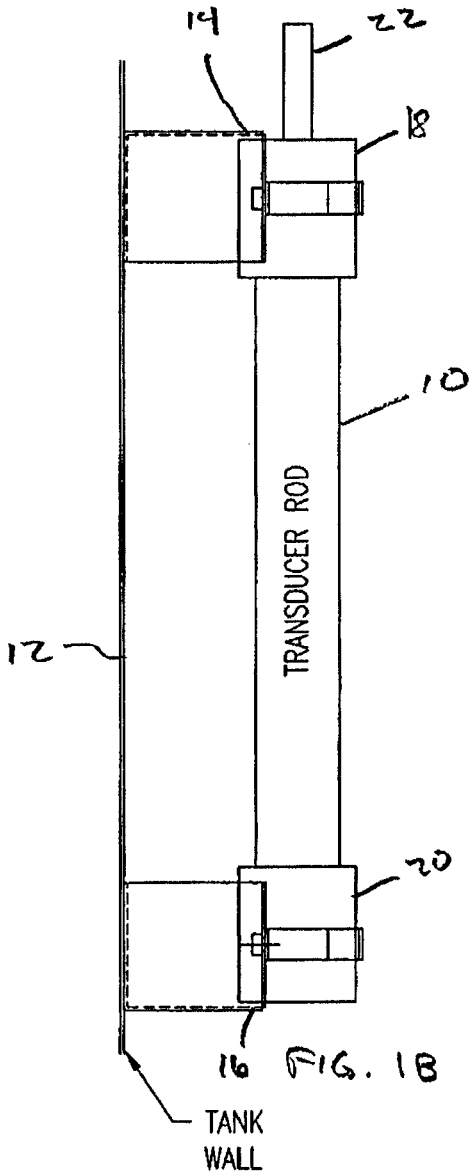
Figure 1C:
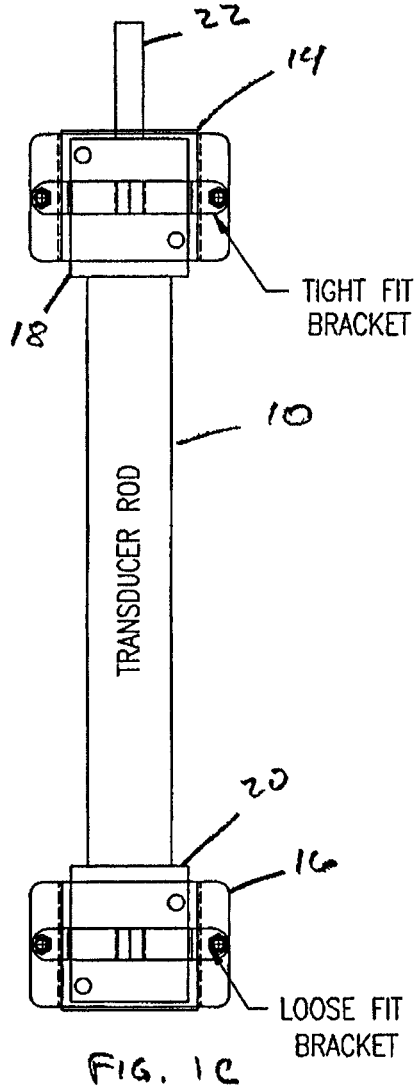
Figure 2:
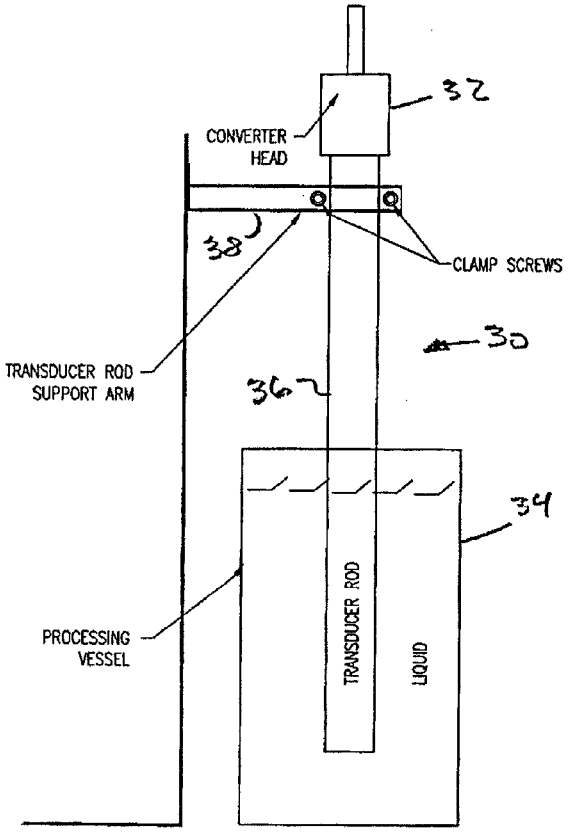
FIG. 2 PRIOR ART
FIG. 2 is a side view of another prior art mounting of an ultrasonic rod transducer using a clamping bracket.
Figure 5:
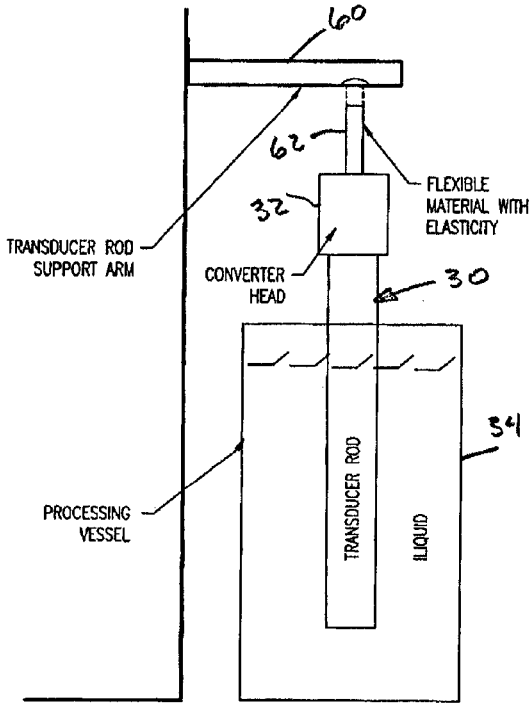
FIG. 5 is a side view of another embodiment of an unrestricted mounting for an ultrasonic transducer according to the present invention.

Another embodiment of the present invention is shown in FIG. 5. This embodiment is similar to the embodiment shown in FIG. 4, but uses a single-ended rod transducer 30 instead of a double-ended rod transducer 10. A support arm 60 projects over the processing vessel or tank 34. An elastic support 62 is attached to the converter head 32 and to the support arm 60, and supports the rod transducer 30 without restricting the transfer of ultrasonic energy to the processing liquid.

Figure 6:
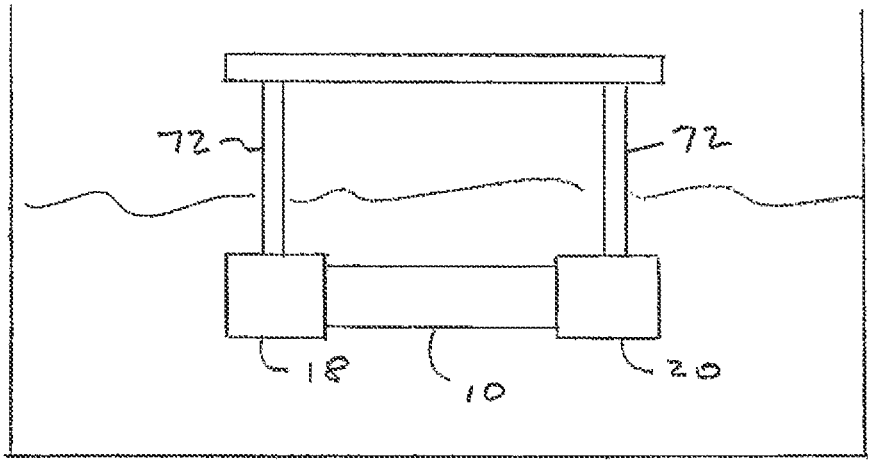
FIG.6 is a side view of another embodiment of an unrestricted mounting for an ultrasonic transducer according to the present invention.

Another embodiment of the present invention, shown in FIG. 6, includes two elastic supports 72, each of which is like the elastic supports described above. Each elastic support 72 is attached at its lower end to one of the converter heads 18 and 20, and the rod transducer 10 is suspended inside the tank in a horizontal orientation. Another embodiment, not shown, includes two support arms and two elastic supports, with each support arm supporting an elastic support and a corresponding end of the rod transducer to horizontally suspend the rod transducer inside the tank. Alternatively, the elastic supports could be of different lengths, or the support arms positioned at different levels so that the rod transducer is suspended at an orientation between horizontal and vertical.

From the above description, it will be apparent that the invention disclosed herein provides a novel and advantageous support structure for ultrasonic rod transducers. The foregoing discussion discloses and describes merely exemplary methods and embodiments of the present invention. As will be understood by those familiar with the art, the invention may be embodied in various other forms without departing from the spirit or essential characteristics thereof. Accordingly, the disclosure of the present invention is intended to be illustrative, but not limiting, of the scope of the invention, which is set forth in the following claims.

The invention claimed is:

1. A processing apparatus comprising:

an ultrasonic rod transducer having a rod and a converter head located at an end of the rod, wherein the ultrasonic rod transducer is adapted for transmitting ultrasonic vibrations to a liquid;

a tank for containing a liquid; and a support structure that supports the weight of the ultrasonic rod transducer to position at least a portion of the ultrasonic rod transducer inside the tank, wherein the support structure includes a supporting bracket having an open cradle that supports the weight of the ultrasonic rod transducer inside the tank, wherein the ultrasonic rod transducer rests in the open cradle and is free to vibrate without restriction from the supporting bracket.

2. A processing apparatus as recited in claim 1 wherein the support structure includes two supporting brackets attached to the tank to support the ultrasonic rod transducer in a horizontal position inside the tank.

3. A processing apparatus as recited in claim 2 wherein each supporting bracket has an open cradle that supports a converter head of the ultrasonic rod transducer.

4. A processing apparatus as recited in claim 1, wherein the tank has at least one side wall, and wherein the supporting bracket is attached to a side wall of the tank.

5. A processing apparatus comprising:

an ultrasonic rod transducer having a rod and a converter head located at an end of the rod, wherein the ultrasonic rod transducer is adapted for transmitting ultrasonic vibrations to a liquid;

a tank for containing a liquid and one or more objects immersed in the liquid, wherein the ultrasonic rod transducer supplies ultrasonic energy to the liquid for processing the one or more objects immersed in the liquid; and a support structure that supports the weight of the ultrasonic rod transducer to position at least a portion of the ultrasonic rod transducer inside the tank, wherein the support structure includes a stationary support arm extending over the tank and an elastic support attached to the support arm and to an end of the ultrasonic rod transducer to support the weight of the ultrasonic rod transducer.

6. A processing apparatus as recited in claim 5 wherein the support structure supports the ultrasonic rod transducer in a vertical position inside the tank.

7. A processing apparatus as recited in claim 5 wherein the support structure supports the ultrasonic rod transducer in a vertical position with a lower portion of the ultrasonic rod transducer inside the tank.

8. A processing apparatus as recited in claim 5 wherein the support structure includes a second elastic support attached to another end of the ultrasonic rod transducer to support the weight of the ultrasonic rod transducer inside the tank.

9. A processing apparatus as recited in claim 5, wherein the elastic support is composed of polymer or rubber.

10. A processing apparatus as recited in claim 9, wherein the elastic support is in the shape of wire or chain.

11. A processing apparatus comprising:

an ultrasonic rod transducer having a rod and a converter head located at an end of the rod;

a tank for containing a liquid; and supporting means for supporting the weight of the ultrasonic rod transducer to position at least a portion of the ultrasonic rod transducer inside the tank, wherein the supporting means includes a supporting bracket having an open cradle that supports the weight of the ultrasonic rod transducer inside the tank, wherein the ultrasonic rod transducer rests in the open cradle and is free to vibrate without restriction from the supporting bracket.

12. A processing apparatus as recited in claim 11 wherein the supporting means includes two supporting brackets attached to the tank to support the ultrasonic rod transducer in a horizontal position inside the tank.

13. A processing apparatus as recited in claim 12 wherein each supporting bracket has an open cradle that supports a converter head of the ultrasonic rod transducer.

14. A processing apparatus as recited in claim 11, wherein the tank has at least one side wall, and wherein the supporting bracket is attached to a side wall of the tank.

* * * * *